US005156684A

United States Patent [19]

Mayer et al.

[11] Patent Number: 5,156,684

[45] Date of Patent: Oct. 20, 1992

[54] AIR BRUSH SET

[75] Inventors: John F. Mayer, Fort Thomas, Ky.; Paul J. Van Risseghem, Delhi Township, Ohio

[73] Assignee: Tonka Corporation, Kenner Division, Minnetonka, Minn.

[21] Appl. No.: 575,945

[22] Filed: Aug. 31, 1990

[51] Int. Cl.[5] ..... B05B 7/28

[52] U.S. Cl. ..... 118/301; 118/304; 239/270; 239/274; 239/326; 239/346; 401/263; 401/266; 401/DIG. 3

[58] Field of Search ..... 118/301, 304; 239/270, 239/274, 308, 326, 346, 348, 530, DIG. 14; 401/204, 263, 266, DIG. 3

[56] References Cited

U.S. PATENT DOCUMENTS

| | | | |
|---|---|---|---|
| 665,747 | 1/1901 | Martin | 101/129 |
| 818,649 | 4/1906 | Wolf | 239/308 |
| 1,271,457 | 7/1918 | Gaines | 401/188 |
| 1,538,951 | 5/1925 | Pringle | 101/115 |
| 1,782,681 | 11/1930 | Foss et al. | 401/188 |
| 1,951,057 | 3/1934 | Leitch | 401/188 |
| 2,134,899 | 11/1938 | Vogel | 239/326 |
| 3,262,609 | 7/1966 | Poitras | 239/308 |
| 4,023,524 | 5/1977 | Goldfarb et al. | 118/301 |
| 4,542,039 | 9/1985 | Dowzall | 427/261 |
| 4,549,243 | 10/1985 | Owen et al. | 239/690 |
| 4,685,622 | 8/1987 | Shimohira et al. | 239/346 |

FOREIGN PATENT DOCUMENTS

| | | | |
|---|---|---|---|
| 208247A | 1/1987 | European Pat. Off. | 239/308 |
| 2709217 | 9/1978 | Fed. Rep. of Germany | 239/346 |
| 88777 | 3/1921 | Switzerland | 239/326 |
| 2035138A | 6/1980 | United Kingdom | 239/346 |

*Primary Examiner*—Jay H. Woo
*Assistant Examiner*—Khanh P. Nguyen
*Attorney, Agent, or Firm*—Marshall, O'Toole, Gerstein, Murray & Bicknell

[57] ABSTRACT

An air brush set including an air brush handle having a nozzle, a tank in communication with the handle, a pump in communication with the tank which is capable of increasing the pressure of gas within the tank and an ink source having a felt tip adapted to act in communication with the air brush nozzle.

38 Claims, 3 Drawing Sheets 20
30
152
154
156
158
162
164
166
172
174
176
180
190
192
194
196
198

AIR BRUSH SET

FIELD AND BACKGROUND OF THE INVENTION

This invention relates generally to an air brush kit and more particularly to an air brush kit having a pressurized air tank in communication with the air brush, and an ink source which comprises a special tip to act in conjunction with the air brush. The invention is especially suited for use by younger people.

There have been numerous types of air brushes which have been marketed over the years. Such air brushes include a variety of pressurized gas sources, ink or paint reservoirs, actuating means and spray nozzles. Normally, the air brushes are sophisticated machines which comprise numerous moving parts and require a sophisticated operator. For example, Nita, EP-208-247-A discloses an air brush having a gas bomb which, through a number of pressure regulators, releases gas out a nozzle and over the standard tip of a felt-tipped pen. Unfortunately, when released from a compressed gas bomb into the atmosphere, the gas experiences a drop in temperature such that when exposed to water-based inks, the gas could actually freeze water based inks in the felt tip. Also, gas bombs are generally operated at pressures of 30 pounds per inch or greater, which is not safe for use by younger people. Pfeiffer, U.K. Patent Application GB 2 035 138A discloses an air brush utilizing a felt-tipped pen, compressed air and an air valve, which can be used with a stencil to mark objects with ink or paint. The use of a standard felt tip on an ink pen, as suggested by Pfeiffer, will quickly dry out when subjected to a flow of air. Further, relatively high pressures are necessary to obtain adequate ink flows from the standard pen tip.

Martin, U.S. Pat. No. 665,747, discloses a spraying device utilizing a hand pump to compress air in a chamber. The compressed air is then released through a nozzle and past an adjacent fluid reservoir nozzle to draw fluid in the reservoir into the stream of air and onto a stencil. Wolf, U.S. Pat. No. 818,649, also discloses an ink spraying system that includes a manually operated pump and a clamp to restrict a flexible tube which feeds pressurized air to the nozzle.

Both Leitch U.S. Pat. No. 1,951,057, and Foss et al., U.S. Pat. No. 1,782,681, disclose the use of pressurized air to force ink or paint through a nozzle. In both cases the pressurized air is applied as back pressure to the ink reservoir.

Gaines, U.S. Pat. No. 1,271,457, discloses an ink-filled reservoir having a porous tip for the flow of ink. The ink is forced through the porous tip by a finger-actuated rubber bulb pump mounted on the side of the reservoir.

A type of pressurized painting system is disclosed in Goldfarb et al., U.S. Pat. No. 4,023,524, which is intended to be used primarily by youngsters. That system resembles a hand-held gun which has a hand pump integrally mounted in the handle. By squeezing the pump, a bellows is activated which forces air though a tube and out a nozzle. Adjacent the nozzle is an outlet for a paint reservoir. The paint is drawn into the air stream due to the relative low pressure at the paint outlet nozzle as compared with the internal pressure of the reservoir.

It is the general object of this invention to provide an air brush set that is simple in its construction, and therefore relatively inexpensive to manufacture, and simple for young people to use.

SUMMARY OF THE INVENTION

An air brush set in accordance with this invention comprises an air brush handle having a nozzle, a tank in communication with the handle, a pump in communication with the tank which is capable of increasing the pressure of gas within the tank and an ink source having a felt tip adapted to act in communication with the air brush nozzle, whereby the pump is operated to build up pressurized gas within the tank which is then released to the air brush handle and out of the nozzle and brought into communication with the felt tip of the ink source, drawing ink from the ink source and into the flow of gas.

There may also be provided an easel upon which stencils can be placed for the creation of multicolored artworks.

Also in accordance with this invention is a felt-tipped marker having an outwardly extending felt tip having a hole therethrough.

BRIEF DESCRIPTION OF THE DRAWINGS

The invention will be better understood from the following detailed description taken in conjunction with the accompanying figures of the drawings, wherein.

DETAILED DESCRIPTION OF THE DRAWINGS

Figure 1:
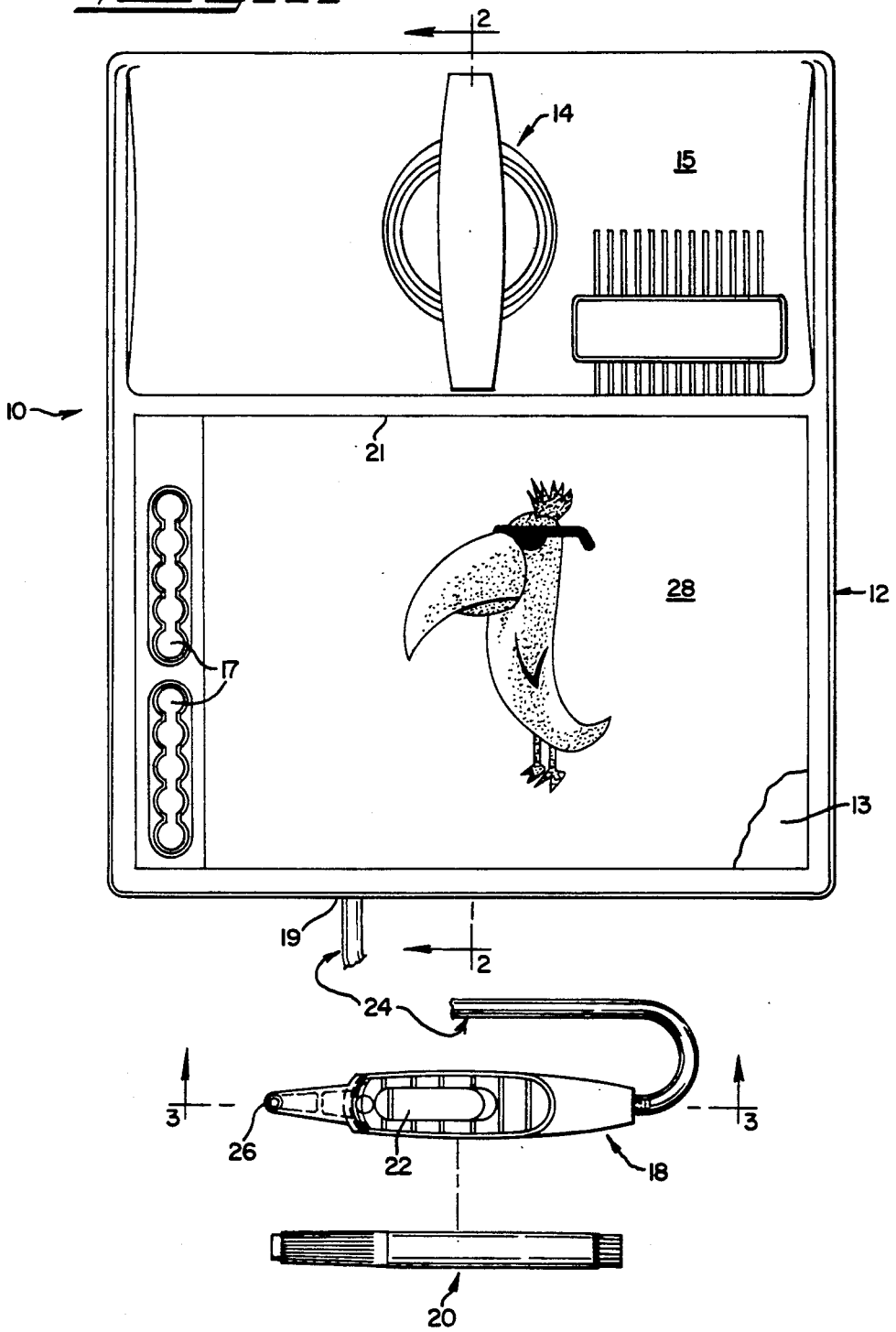
FIG. 1 is a plan view of an air brush set in accordance with the present invention.

FIG. 1 illustrates a specific example of an air brush set 10 in accordance with the present invention. An easel 12 is depicted, having a generally flat work surface 13. The easel 12 pictured also houses a pump 14 and a tank 16 in its rearward section 15. Pen holders 17 are provided to store marking pens when not in use. An air brush handle 18 is in fluid communication with the tank 16 via an air hose 24 which is fed through an easel 12 at an opening 19. The air brush handle 18 is adapted to hold a felt-tipped marker 20. A piece of paper 28 having a completed composite design 30 is illustrated on the work surface 13 of the easel 12.

The user of the air brush set 10 will work on the easel 12 using stencils (illustrated in FIGS. 6*a*–6*d*). Initially, the user operates the pump 14 to build up pressure in the tank 16 (illustrated in FIG. 2). Next, the air brush handle 18 is fitted with the felt-tipped marker 20, and a trigger 22 is depressed to release the pressurized air stored in the tank 16 which then passes through a hose 24 to the nozzle 26 of the air brush handle 18. Once the pressurized air exits the nozzle 26, it passes through the felt tip 30 (see FIGS. 4 and 5) of the marker 20 and onto the paper 28 and stencil 30 resting in a recess 21 of the work surface 13 of the easel 12.

Figure 2:
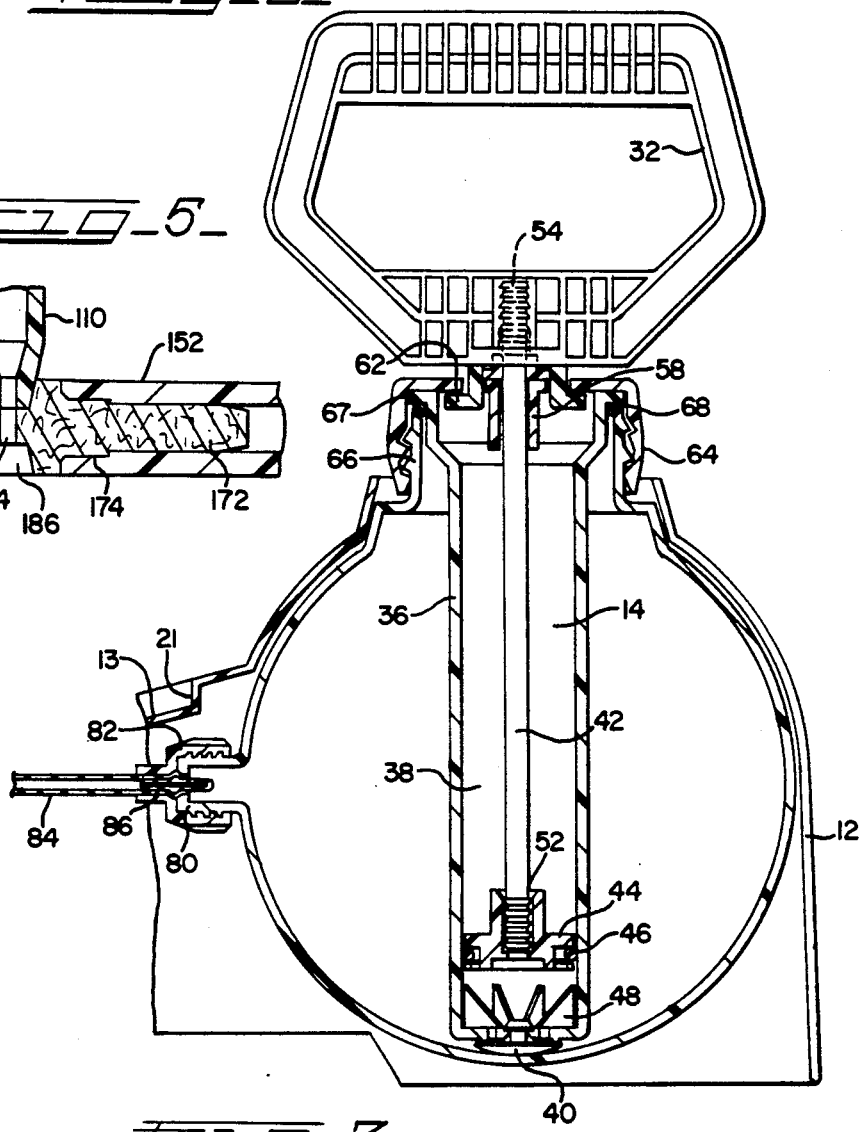
FIG. 2 is a partial sectional view of the easel, tank and hand pump taken along line 2—2 in FIG. 1.

FIG. 2 further illustrates the pump 14 and the tank 16. The pump 14 is operated by raising a handle 32 which is joined to a piston 34 mounted in a cylinder 36, and the pushing down on the handle 32 causing the piston 34 to force air out of cylinder 36 through a one-way valve 40 and into the tank 16.

The piston 34 comprises a shaft 42 which connects handle 32 to a head 44. The piston head 44 is generally disk-shaped and is of a slightly smaller size than the interior diameter of the cylinder 36. A seal 46 (preferably an o-ring) is fitted around the periphery of the piston head 44 to create a substantially air-tight seal between the portions of the chamber 36 that are above and below the piston head 44 at any given time. Convential blow-by holes in the piston head 44 are provided (not illustrated) which permit air to enter the portion of the chamber below the piston head 44 when the handle 32 is raised and also to bleed off some air pressure when the handle 32 is being lowered to reduce the amount of downward pressure required to lower the piston 34.

The piston shaft 42 runs parallel to the axis of the cylinder 36 and is fixed at its lower end 52 to the piston head 44. The upper end 54 is fixed to the handle 32. A cylindrical guide 58 is formed integrally with the collar 64 and is provided for the piston shaft 42 so that the vertical pumping motions remain vertical and do not become skewed with respect to the axis of the cylinder 36.

Fins 48 are provided for structural stability of the pump 14. They are vertically positioned in the bottom of the chamber 36 and are spaced apart from one another (as illustrated) so as not to interfere with the flow of air toward the one-way valve 40. The one-way valve is preferably a compression molded rubber umbrella valve.

When the tank has been pumped to the desired pressure (discussed below), the handle 32 can be locked in the down (illustrated) position through the use of stops 62. The stops 62 are mounted on the bottom of the handle 32 and extend downwardly and then outwardly to appear generally L-shaped. During operation, the handle is turned 90 degrees from the position illustrated in FIG. 2 and the stops 62 move through slots (not shown) in the collar 64 and do not interfere with the operation. When the desired tank pressure is reached, the handle 32 is pushed down and turned 90 degrees so that the stops 62 move under and engage collar 64. The collar 64 is threaded onto a neck 66 of the tank 16 to join the tank 16 to the upper end 67 of the pump 14. A gasket 68 is positioned between the pump 14 and the tank 16 during assembly to ensure a substantially air-tight seal between the two.

The air brush set 10 is preferably operated at air pressures between two and twenty pounds per square inch. As a practical matter, it will be very difficult for a young person to pump the tank to a higher pressure, but if pressures of higher than twenty to twenty-five pounds per square inch are reached, a friction fitting (not shown) on the hose 84 which joins the hose 84 to the air brush handle 18 is designed to fail and release the pressure within the tank 16.

The tank should preferably be sized so that the operating time of the air brush is no less than thirty seconds per pressurizing of the tank 16. Naturally, a number of factors enter into this feature, including tank size, maximum tank pressure and nozzle opening size. The maximum tank pressure is stated above as being about 20 psi while the optimum tank size should be about 225 to 275 cubic inches, although this is not as critical to the operation of the set as it is to the size of the set and the amount of time that it should reasonably take a young person to pressurize the tank.

The tank is formed with a male tube fitting 80 in its wall. A female tube fitting 82 joined to the end of a resilient hose 84 is fitted with a relatively rigid nipple 86 inserted into the end of the tube 84 to ensure a clear opening from the tank 16 to the tube 84. Tube 84 terminates at a male fitting 92 (FIG. 3) which is joined to the rear portion 102 of the air brush 18.

Figure 3:
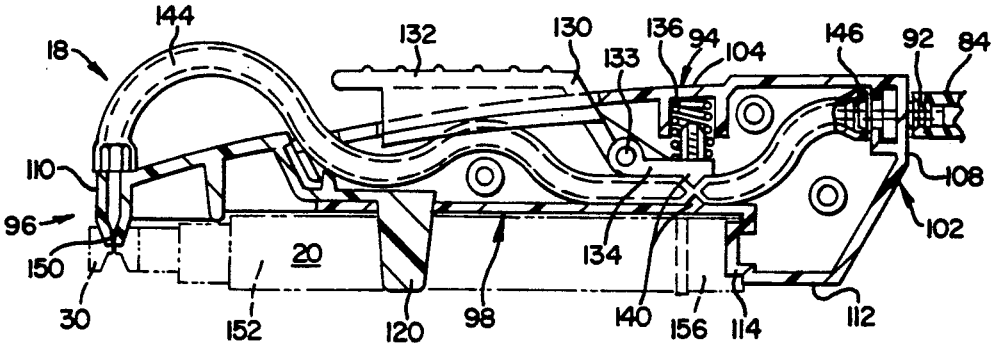
FIG. 3 is an enlarged partial sectional view of the air brush taken along line 3—3 in FIG. 1.

The air brush 18, illustrated in FIG. 3, has a hollow frame 94 having a front portion 96, central portion 98, and a rear portion 102. The top wall slopes down from the rear 102 to the front 96 where it meets a nozzle 110.

Rear wall 108 extends vertically downward from top wall 104 where it joins a rear pen holder 112 formed integrally with the walls of the air brush 18.

The rear marker holder 112 joins the rear wall 108 and the bottom wall 106 and has a forwardly projecting male connector 114 that is adapted to fit into the hollow rear cap 156 of the felt-tipped marker 20. The rear marker holder 112 also serves as a convenient base upon which the air brush 18 can rest when not in use.

A bracket 120 extends downwardly from the bottom wall 106 and comprises two resilient opposing arms. To install the felt-tipped marker 20, the hollow rear cap 156 of the marker is placed over the male connector 114 of the rear marker holder 112 and the barrel 152 of the marker is forced upward against the opposing arms of the bracket 120. The barrel 152 forces the arms apart until the marker snaps up into the bracket 120 and snugly holds the marker 20 in place. (See FIG. 3 illustrating dashed outline of marker installed in the handle).

The user operates the air brush 18 by holding it in one hand and depressing a lever 130 having a trigger end 132 which projects upwardly through an opening in the top wall 104. By depressing the trigger 132, the lever 130 is rotated counterclockwise about a pivot pin 133 and a clamp end 134 is raised upwardly against the force of a spring 136. This raising of the clamp end 134 of the lever 130 separates opposing jaws 140 which are mounted on the clamp end 134 and the inside of the bottom wall 106.

Positioned between the jaws 140 is a resilient hose 144, which extends from a male fitting 146 in the rear wall 108, through the jaws 140, and terminates at the nozzle 110. When the pressure on the hose 144 extended by the jaws is released by depressing the trigger 132, the resilient hose 144 opens and permits the passage of pressurized gas from the hose 84 and ultimately from the tank 16. When the operator wishes to stop the flow of pressurized gas, the trigger 132 of the lever 130 is released and the force of the spring 136 rotates the lever 130 clockwise about the pivot pin 133, thereby allowing the force of the spring 136 to close the jaws 140 on the hose 144.

Once the pressurized gas leaves the hose 144, it enters the air brush nozzle 110. The nozzle 110 has formed in it a restricting bore 150 which decreases in cross-sectional area and thereby increases the velocity of the pressurized gas. The viscosity of the ink will be partially determinative in choosing a nozzle opening size. It can range in size from 0.016 inches in diameter to 0.025 inches in diameter when used with water-based ink and is preferably 0.020 inches in diameter. This size provides optimum spraying time and spray performance. The exterior of the nozzle is also tapered and is designed to interact with the felt tip of the marker 20 by fitting into a socket described below.

Figures 4, 6A, 6B, 6C, 6D:
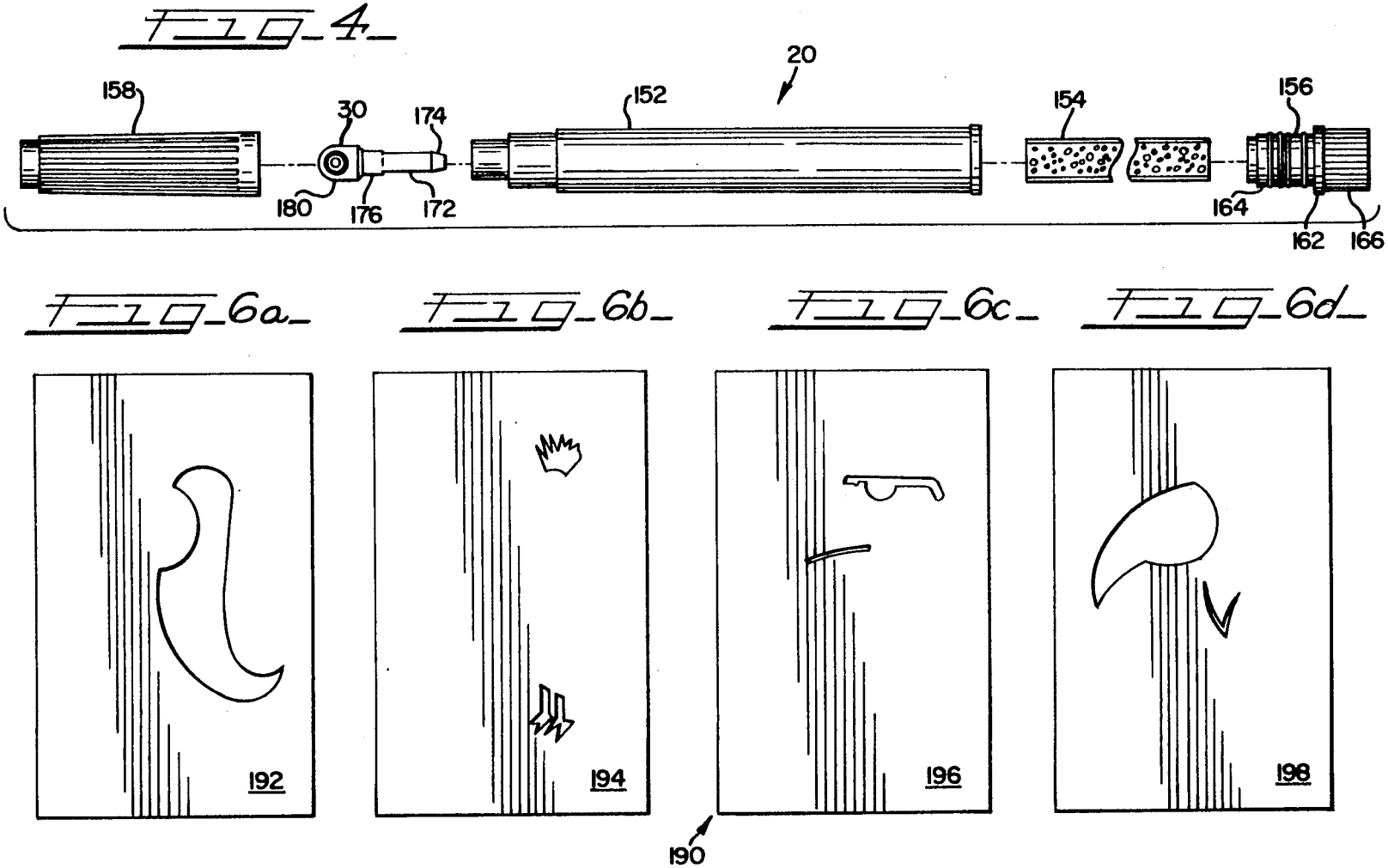
FIG. 4 is an exploded view of a felt-tipped marker in accordance with the present invention.
FIGS. 6*a*–6*d* are plan views of stencils used in conjunction with the air brush of the present invention.

FIG. 4 illustrates the felt-tipped marker 20 intended for use with the air brush 18 described above. It is noted that the term "felt tip" is commonly used by consumers and manufacturers alike to describe a commercially available pen. However, while it is believed that the tip is a porous crushed polyethylene, the actual composition is a trade secret known only to the manufacturers. Two of those manufacturers are Porex, Inc. and Chromex, Inc.

The marker 20 comprises a barrel 152, an ink reservoir 154, a felt tip 30, a hollow rear cap 156, and a hollow tip cap 158. The ink reservoir 154 is preferably a fibrous cartridge that is positioned inside the barrel 152 and bears against the felt tip 30 so that ink can flow by capillary action from the reservoir 154 to the tip 30.

The hollow rear cap 156 is essentially a solid disk 162 with a hollow cylinder extending from each face of the disk. One hollow cylinder 164 is provided with compression ribs to join with the barrel and allow the ink reservoir 154 to fit into its hollow portion. The other hollow cylinder 166 is designed to interact with the rear pen holder 112 (see FIG. 3) to support the marker. The tip cap 158 snaps over the felt tip 130 to prevent the marker from drying out when not in use.

Figure 5:
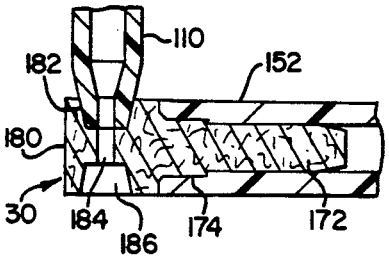
FIG. 5 is an enlarged sectional view of the air brush nozzle in contact with the felt tip of the ink source of the present invention.

The specially adapted felt tip 30 is best illustrated in FIGS. 4 and 5. It comprises a solid interior cylindrical section 172 which extends into the barrel 152 and has a slight taper 174 at its end for ease of assembly. An intermediate cylindrical section 176 is positioned on the same axis as the interior cylindrical section 172 and provides a transition from the interior section 172 to the spray tip 180. Both sections are securely fitted into the barrel 152.

The illustrated felt tip 30 is designed to interact with the nozzle 110 by providing a socket 182 in which the tapered nozzle 110 can fit. The socket 182 itself can be tapered but it is not necessary. A hole 184 through which pressurized air can pass and draw ink from the porous felt tip 30 is provided in the tip 180 and is preferably about 0.050 inches in diameter when the nozzle opening is 0.020 inches in diameter, but this dimension is not as critical as the nozzle opening dimension. There is also provided another socket 186 which can also interact with the nozzle 110 depending upon how the marker 20 is inserted, but, as illustrated in FIG. 5, can act as a directional aperture which functions to direct ink downwardly rather than randomly.

The hole 184 in the spray tip 180 also improves the operation of the air brush because the spray tip 180 does not dry out as quickly as standard felt tips when used under similar conditions. Further, generally higher air pressures are required to draw ink from standard felt tips, but the tip 180 of the present invention can be operated at air pressures as low as two pounds per square inch.

The felt tip 30 of the present invention can also be used in conjunction with air brush units intended for use by adults that include gas bombs as a source for pressurized gas and alcohol-based inks. Because lower air pressures and volumes can be utilized with the adapted spray tip 180, the gas bombs last considerably longer.

The felt tip markers 20 are preferably water-based when intended for use by younger people and available in a variety of colors. A different color can then be used with a series of stencils 190 (see FIGS. 6*a*–6*d*) to obtain a multicolored ink picture using the air brush set described above. The user simply operates the pump 14 to pressurize the tank 16 to about 15–20 psi, then snaps a colored felt-tipped marker into the air brush handle 18, making sure that the nozzle 110 and the socket 182 engage to line up the nozzle 110 with the hole 184. The first stencil 192 is placed on the easel 12 and in the recess 21. By squeezing the lever 22 on the air brush 18, pressurized air is released through the nozzle 110 and the spray tip 180 which draws ink into the stream of air and onto the stencil below. Once spraying with the first stencil is completed, the process can be repeated using different colored markers with the other stencils placed in the recess 21 to produce the composite design 30 on a piece of paper 28 as shown in FIG. 1. It will be apparent from the foregoing that an improved toy air brush set and adapted felt-tipped marker have been provided.

What is claimed is:

1. Apparatus comprising:

(a) an air brush handle having a nozzle;

(b) a tank in communication with the air brush handle;

(c) a hand pump in communication with the tank which is capable of increasing the pressure of a gas in the tank;

(d) means for controlling the flow of pressurized gas from the tank to the air brush handle; and (e) an interchangeable ink source removably fastened to the air brush handle and having a felt tip which at least partially surrounds the flow pressurized gas from the nozzle of the air brush handle, whereby the pump is operated to build up pressurized gas within the tank which is then released to and out of the nozzle of the air brush handle and brought in communication with the felt tip of the ink source, drawing ink from the ink source and into the flow of gas.

2. Apparatus according to claim 1 in which the felt tip defines a hole through which pressurized gas may flow.

3. Apparatus according to claim 1 in which the felt tip defines a socket adapted to receive the nozzle of the air brush and said felt tip also defines a hole aligned with said socket and nozzle through which pressurized gas from the nozzle may flow.

4. Apparatus according to claim 1 in which the felt tip defines two sockets positioned on opposite sides of the tip and separated by a wall which has a hole therethrough.

5. Apparatus according to claim 1 in which the hand pump is at least partially contained within the tank.

6. Apparatus according to claim 1 in which the hand pump comprises a handle and a chamber and said chamber is contained within the tank.

7. Apparatus according to claim 1 in which the tank has a volume of from 225 cubic inches to 275 cubic inches.

8. Apparatus according to claim 1 in which the nozzle has a substantially round opening that is 0.020 inches in diameter.

9. Apparatus according to claim 1 in which the hand pump is capable of increasing the pressure of the gas in the tank to at least 20 pounds per square inch.

10. Apparatus according to claim 1 in which the operating gas pressures range from about 2 pounds per square inch to 20 pounds per square inch.

11. Apparatus according to claim 1 in which the air brush handle is hollow and comprises:

(a) a front end, a rear end, a top end, a top wall and a bottom wall;

(b) connecting means mounted in the rear end of the handle which is adapted to communicate with the tank;

(c) clamping means mounted on the bottom wall of the handle which is adapted to join the ink source to the handle;

(d) a nozzle mounted on the front end of the handle, in fluid communication with the connecting means and having an opening positioned adjacent the tip of the ink source; and (e) having the means for controlling the flow of pressurized gas from the tank to the air brush handle mounted thereon.

12. Apparatus according to claim 11 in which the means for controlling the flow of pressurized gas from the tank to the air brush handle comprises a lever having:

(a) a trigger end projecting up through an opening in the top wall;

(b) a pivot point mounted inside the hollow handle;

(c) a clamp end concealed with in the hollow handle and having a downwardly extending jaw;

(d) a fixed upwardly extending jaw mounted on the inside of the bottom wall and opposing the downwardly extending jaw of the lever;

(e) a spring having a first end and a second end, said first end abutting the inside of the top wall and jointed at the second end to the clamp end of the lever; and (f) a resilient hose having two ends, one of said ends being fitted to said connecting means and one of said ends being fitted to said nozzle, and disposed between the jaws.

13. Apparatus comprising:

(a) an air brush handle having a nozzle;

(b) a tank in communication with the air brush handle;

(c) a hand pump in communication with the tank which is capable of increasing the pressure of the gas inside the tank;

(d) means for controlling the flow of pressurized gas from the tank to the air brush handle;

(e) an interchangeable ink source removably fastened to the air brush handle and having a felt tip which at least partially surrounds the flow of pressurized gas from the nozzle of the air brush handle; and (f) an easel; whereby the pump is operated to build up pressurized gas within the tank which is then released to, and out of, the nozzle of the air brush handle and brought into communication with the felt tip of the ink source, drawing ink from the ink source and into the flow of gas which is directed to the easel.

14. Apparatus according to claim 13 in which the felt tip defines a hole through which pressurized gas may flow.

15. Apparatus according to claim 13 in which the felt tip defines a socket adapted to receive the nozzle of the air brush handle and said felt tip also defines a hole aligned with said socket and nozzle through which pressurized gas from the nozzle may flow.

16. Apparatus according to claim 13 in which the felt tip defines two sockets positioned on opposite sides of the tip and separated by a wall which has a hole therethrough.

17. Apparatus according to claim 13 in which the hand pump is at least partially contained within the tank.

18. Apparatus according to claim 13 in which the hand pump comprises a handle and a chamber and said chamber is contained within the tank.

19. Apparatus according to claim 13 in which the tank has a volume of from 225 cubic inches to 275 cubic inches.

20. Apparatus according to claim 13 in which the a nozzle has a substantially round opening that is 0.020 inches in diameter.

21. Apparatus according to claim 13 in which the hand pump is capable of increasing the pressure of the gas in the tank to at least 20 pounds per square inch.

22. Apparatus according to claim 13 in which the operating gas pressures range from about 2 pounds per square inch to 20 pounds per square inch.

23. Apparatus according to claim 1 in which the air brush handle is hollow and comprises:

(a) a front end, a rear end, a top end, a top wall and a bottom wall;

(b) connecting means mounted in the rear end of the handle which is adapted to communicate with the tank;

(c) clamping means mounted on the bottom wall of the handle which is adapted to join the ink source to the handle;

(d) a nozzle mounted on the front end of the handle, in fluid communication with the connecting means and having an opening positioned adjacent the tip of the ink source; and (e) having the means for controlling the flow of pressurized gas from the tank to the air brush handle mounted thereon.

24. Apparatus according to claim 23 in which the means for controlling the flow of pressurized gas from the tank to the air brush handle comprises a lever having:

(a) a trigger end projecting up through an opening in the top wall;

(b) a pivot point mounted inside the hollow handle;

(c) a clamp end concealed with in the hollow handle and having a downwardly extending jaw;

(d) a fixed upwardly extending jaw mounted on the inside of the bottom wall and opposing the downwardly extending jaw of the lever;

(e) a spring having a first end and a second end, said first end abutting the inside of the top wall and joined at the second end to the clamp end of the lever; and (f) a resilient hose having two ends, one of said ends being fitted to said connecting means and one of said ends being fitted to said nozzle, and disposed between the jaws.

25. Apparatus according to claim 13 in which the pump is disposed, partially, inside of the tank and the tank is disposed inside of the easel.

26. Apparatus comprising:

(a) an air brush handle having a nozzle;

(b) a tank in communication with the air brush handle;

(c) a hand pump in communication with the tank which is capable of increasing the pressure of a gas in the tank;

(d) means for controlling the flow of pressurized gas from the tank to the air brush handle;

(e) an interchangeable ink source removably fastened to the air brush handle and having a felt tip which at least partially surrounds the flow of pressurized gas from the nozzle of the air brush handle;

(f) an easel; and (g) a plurality of templates adapted to be positioned on the easel, whereby the pump is operated to build up pressurized gas within the tank which is then released to, and out of, the nozzle of the air brush handle and brought into communication with the felt tip of the ink source, drawing ink from the ink source and into the flow of gas which is directed to at least one of the templates on the easel.

27. Apparatus comprising:

(a) an air brush handle having a nozzle;

(b) a tank in communication with the air brush handle;

(c) a hand pump in communication with the tank which is capable of increasing the pressure of a gas in the tank; and (d) an interchangeable ink source removably fastened to the air brush handle and having a felt tip which at least partially surrounds the flow of pressurized gas from the nozzle of the air brush handle, whereby the pump is operated to build up pressurized gas within the tank which is then released to and out of the nozzle drawing ink from the ink source and into the flow of gas.

28. Apparatus according to claim 27 in which the felt tip defines a socket adapted to receive the nozzle of the air brush handle and a hole aligned with the socket and nozzle through which pressurized gas from the nozzle flows.

29. Apparatus according to claim 27 in which the felt tip defines two sockets positioned on opposite sides of the felt tip and separated by a wall which has a hole through which pressurized gas from the nozzle flows.

30. Apparatus according to claim 27 further comprising a plurality of interchangeable ink sources capable of being removably fastened to the air brush handle and having felt tips which at least partially surround the flow of pressurized gas from the nozzle of the air brush handle.

31. Apparatus according to claim 27 in which the hand pump is at least partially contained within the tank.

32. Apparatus according to claim 27 in which the hand pump comprises a handle and a chamber and the chamber is contained within the tank.

33. Apparatus according to claim 27 in which the tank has a volume of from 225 cubic inches to 275 cubic inches.

34. Apparatus according to claim 27 in which the nozzle has a substantially round opening that is 0.20 inches in diameter.

35. Apparatus according to claim 27 in which the operating gas pressures range from about 2 pounds per square inch to 20 pounds per square inch.

36. Apparatus according to claim 27 in which the air brush handle is hollow and comprises:

(a) a front end, a rear end, a top wall, and a bottom wall;

(b) connecting means mounted in the rear end of the handle which is adapted to communicate with the tank;

(c) clamping means mounted on the bottom wall of the handle which is adapted to join the ink source to the handle;

(d) a nozzle mounted on the front end of the handle, in fluid communication with the connecting means and having an opening positioned adjacent the tip of the ink source; and (e) having the means for controlling the flow of pressurized gas from the tank to the air brush handle mounted thereon.

37. Apparatus according to claim 36 in which the means for controlling the flow of pressurized gas from the tank to the air brush handle comprises a lever having:

(a) a trigger end projecting up through an opening in the top wall;

(b) a pivot point mounted inside the hollow handle;

(c) a clamp end concealed within the hollow handle and having a downwardly extending jaw;

(d) a fixed upwardly extending jaw mounted on the inside of the bottom wall and opposing the downwardly extending jaw of the lever;

(e) a spring having a first end and a second end, the first end abutting the inside of the top wall and joined at the second end to the clamp end of the lever; and (f) a resilient hose having two ends, one of said ends being fitted to said connecting means and one of said ends being fitted to said nozzle, and disposed between the jaws.

38. Apparatus comprising:

(a) an air brush handle having a nozzle and means operable to releasably hold an ink source;

(b) a tank in communication with the air brush handle;

(c) a hand pump in connection with the tank which is capable of increasing the pressure of a gas in the tank;

(d) means for controlling the flow of pressurized gas from the tank to the air brush handle; and (e) an ink source removably fastened to the air brush handle and having a felt tip which at least partially surrounds the flow of pressurized gas from the nozzle of the air brush handle, whereby the pump is operated to build up pressurized gas within the tank which is then released to and out of the nozzle of the air brush handle and brought in communication with the felt tip of the ink source, drawing ink from the ink source and into the flow of gas.

* * * * *